United States Patent [19]

Hammarskog

[11] Patent Number: 4,613,364

[45] Date of Patent: Sep. 23, 1986

[54] METHOD AND MEANS FOR MANUFACTURING A PREFORMED METAL PRODUCT

[75] Inventor: Björn Hammarskog, Sala, Sweden

[73] Assignee: SKF Steel Engineering, A.B., Hofors, Sweden

[21] Appl. No.: 700,656

[22] Filed: Feb. 11, 1985

[30] Foreign Application Priority Data

Aug. 2, 1984 [SE] Sweden ..... 8403953

[51] Int. Cl.[4] ..... C22B 5/12

[52] U.S. Cl. ..... 75/34; 419/50; 419/69

[58] Field of Search ..... 419/48, 50, 63, 66, 419/69; 75/33, 35, 34

[56] References Cited

U.S. PATENT DOCUMENTS 3,710,808 1/1973 Celada et al. ..... 75/34

4,251,267 2/1981 Beggs et al. ..... 75/35

*Primary Examiner*—Melvyn J. Andrews

*Attorney, Agent, or Firm*—Armstrong, Nikaido, Marmelstein & Kubovcik

[57] ABSTRACT

A method and a means for continuously producing a preformed metal product through direct reduction of a material containing ferric oxide in a shaft furnace and feeding the product manufactured in the shaft furnace via a gas lock into a hot preforming machine, the hot product obtained from the shaft furnace being kept at the temperature required for the subsequent hot preforming process, preferably at least about 550° C., by means of hot, non-combustible gas consisting primarily of $N_2$ and/or $CO_2$ which has been heated by excess heat from the shaft furnace.

8 Claims, 1 Drawing Figure

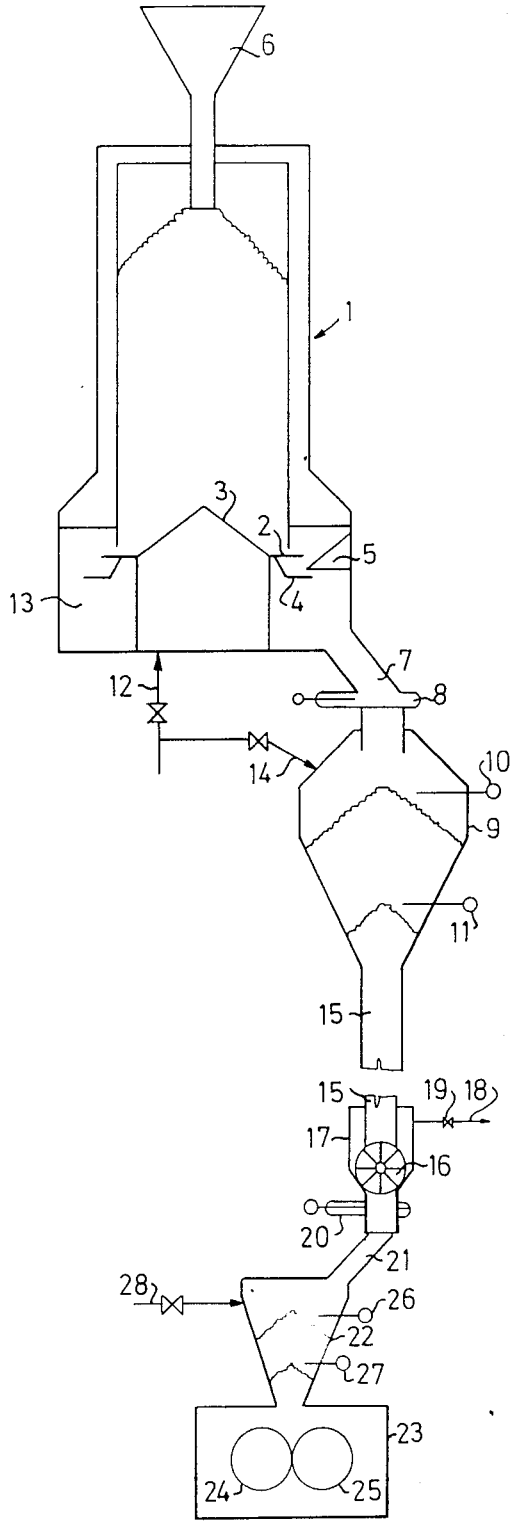
6
1
3
2
5
4
13
7
12
8
14
10
9
11
15
15
19
18
17
16
20
21
28
26
22
27
23
24
25

METHOD AND MEANS FOR MANUFACTURING A PREFORMED METAL PRODUCT

The present invention relates to a method and means for continuous manufacture of a preformed metal product through direct reduction of a material containing ferric oxide in a shaft furnace and feeding the product leaving the shaft furnace into a hot preforming machine. The invention is suitable for both lump ore and pellets.

Shaft furnaces producing a cold sponge-iron product are already known and function with acceptable reliability. However, problems arise with re-oxidation of the cold sponge-iron if it is subjected to draughts of air and/or moisture. To prevent re-oxidation the sponge-iron is suitably preformed. Preforming is preferably performed at temperatures around 650° C. and for this process the sponge-iron product should be withdrawn without prior cooling. However, it is not practicable simply to remove the cooler from a shaft furnace with cold feedout because in counter-flow shaft furnaces, particularly those designed for direct reduction of ferric oxide, the highest gas pressure in the furnace occurs in the lowermost region since the gases flow upwards. The hot reduction gas operating in the furnace would immediately ignite should it come into contact with oxygen in the air, thus constituting a safety risk to both equipment and personnel.

Various technical solutions have been suggested for feeding out hot sponge-iron, some of which are even in commercial use. The general aim has been to prevent any reduction gas from escaping from the furnace shaft. In mechanical valve arrangements which have been suggested, leakage occurs due to clogging and wear, and the volume of material in the sluices is cooled, even at short stoppages in production, to a temperature below that suitable for hot preforming.

Furthermore, both the iron and the combustible gas enclosed in the porous preformed sponge-iron causes undesired heating due to combustion upon exposure to surrounding air and an inert gas must therefore be supplied to reduce the temperature of the preforms to below combustion temperature. Here too the gas enclosed in the sponge-iron constitutes a hazard to personnel.

The object of the present invention is to provide a method and a means for manufacturing a preformed, metallized product in which the drawbacks mentioned above are eliminated.

It has surprisingly been found that this is achieved by utilizing the present invention, wherein the product leaving the shaft furnace is kept at a temperature required for the subsequent hot preforming process, i.e. at least about 550° C., by being caused to pass, together with a non-combustible gas, through a gas lock which connects the shaft furnace to the hot preforming machine, in which gas lock the volume of material is kept at a suitable temperature for hot preforming by supplying heat by the agency of said non-combustible gas.

Feeding out is preferably performed by non-combustible gas being supplied to the feedout chamber of the shaft furnace at a pressure preventing downward flow of combustible reduction gases in the shaft furnace. The non-combustible gas is supplied to the feedout chamber of the furnace where it is heated by excess heat from the furnace, for instance by using the gas as coolant for certain parts of the feedout means, after which the hot non-combustible gas is caused to accompany the hot product passing out of the shaft furnace and through the gas lock to the hot preforming machine and then to accompany the preformed product through subsequent coolers.

According to a preferred embodiment of the invention a gas containing primarily $N_2$ and/or $CO_2$ is used as non-combustible gas, accompanying the material during its passage through the hot preforming machine until the temperature of the preforms is less than about 200° C., or until the material is no longer disposed to reoxidation upon contact with oxygen in the air.

The invention also relates to a means for performing the method, including a shaft furnace and a hot preforming machine, the shaft furnace having a supply means arranged at the top for the starting material containing oxide, a feedout chamber arranged at the bottom, and supply means for gas and energy, said means comprising a gas lock composed of a sealing pipe connected to the feedout chamber of the shaft furnace, the material being fed through said sealing pipe, the diameter and length of which are so dimensioned that when the pipe is filled with material, and at a suitable gas flow, a desired pressure drop greater than zero is obtained, a feedout means arranged at the lower end of the pipe, and a supply means for non-combustible gas to the feedout chamber of the shaft furnace.

Designing the sealing pipe so that a pressure drop greater than zero is obtained at a suitable gas flow from the shaft furnace enables this to be used to keep the material hot during its passage from the shaft furnace to the preforming machine. In the event of a stop in production, the material can be kept hot, at least for a short while, by allowing the hot protective gas to pass through it.

The gas flow is also used to remove combustible reduction gas which is emitted by the sponge-iron for a certain time.

The lack of sluice valves means that the volume of material being fed out is considerably less than in conventional arrangements, as well as the problem of wear, leakage and clogging of the sluice valves being completely eliminated.

A collecting pocket is preferably arranged at the upper end of the pipe. The quantity of material in this pocket can be regulated between an upper and a lower level, ensuring that the pipe is not unintentionally emptied. The level in the pocket can also be used, for instance, to control feedout from the shaft. Means are also arranged in the pocket to the supply of the inert gas allowing the pocket and pipe to be washed clean.

Further advantages and features of the invention will be revealed in the following detailed description with reference to the accompanying drawing, in which The FIGURE shows one embodiment of a means according to the invention with a shaft furnace with rotating table feedout.

The invention will now be described in detail in connection with the manufacture of sponge-iron and preforming this to a metallized product.

The drawing shows a shaft furnace 1 having a feedout means in the form of a rotating bottom 2 with eccentric cone 3. Below said bottom is a rotating feedout table 4 onto which material falls from the shaft. The material is scraped from the rotating table by a blade 5.

The shaft furnace is charged from the top with starting material containing metal oxide, through a supply means 6, shown schematically. Gas and energy are simultaneously supplied in conventional manner, not described in detail here, in the lower region of the shaft furnace.

The material passes through a pipe 7 provided with a closing valve 8, to a first collecting pocket 9. Two level-measuring probes 10, 11 are arranged in the pocket 9 and sense a highest and lowest level of the material in the pocket, which can then be used for control purposes. The gas is supplied through a conduit 12 to the feedout chamber 13 of the shaft, where it is heated and flows with the sponge-iron through the pipe 7.

From the pocket 9, the material is fed through a vertical pipe 15 by means of a feedout device 16 arranged in a pocket 17 at the lower end of the pipe. In the embodiment shown in the drawing, the feedout device comprises a rotary valve which is capable of supporting a column of material in the pipe 15 in the event of a stop in production.

A gas outlet 18 with control valve 19 is arranged in the pocket 17 above the rotary valve, for withdrawal of some of the gas flowing in the pipe. If necessary, the gas withdrawn through valve 19 may be returned to the protective gas inlet 12 after being cleaned and compressed.

A gastight closing valve 20 is arranged below the pocket 17. When the feedout device 16 is stopped, the valve 20 is closed and the column of material in pipe 15 and the material in pocket 9 can be kept hot by means of a hot gas, at least for a short while, before the feedout means is started again. The feedout means 16 thus controls the flow of material through the pipe 15.

The gas flow through pocket 9 and sealing pipe 15 is determined by the pressure in the feedout chamber 13 of the shaft and the pressure drop generated by the flowing gas, over a column of material standing in the pipe. This pressure drop is dependent, inter alia, on the length and diameter of the pipe and on the particle size of the material. The pipe length is normally within the interval ca. 6–12 m.

The gas flow through the sealing pipe 15 can be balanced in an extremely advantageous manner by the control valve 19 in the outlet conduit 18, so that the desired flow is obtained down through the hot preforming machine.

From the feedout means and after passage of the conduit 21 with valve 20, the material falls down into another pocket 22 which communicates directly with the hot preforming machine. This is shown schematically at 23, with two preforming rollers 24, 25.

Level-measuring probes 26, 27 are also arranged in said pocket 22, to record a highest and lowest level, respectively, and supply means 28 is provided for the supply of non-combustible gas. The pocket 22 is preferably as small as possible since it is intended to function only as a buffer to take up variations arising when the hot preforming machine is started up or from fluctuations in production rate.

Non-combustible gas is supplied to pocket 22 through supply means 28 when valve 20 is closed.

The material is normally sufficiently hot after passing through the feedout means. In the event of disturbances or a decrease in the quantity of material fed out, however, it may cool down and, according to the invention, this is compensated by a flow of protective gas through the feedout means.

The non-combustible gas accompanies the material all the way through the hot preforming equipment until its temperature is at most 200° C., at which temperature the iron will no longer be re-oxidized upon coming into contact with oxygen in the air.

The invention can also be used in other reduction shafts, e.g. a reduction shaft with a bottom narrowing conically and central feedout of the material, the feedout being connected directly to the sealing pipe 15, i.e. the pocket 9 is no longer required.

Furthermore, fine particles collected during the hot preforming process can be returned to the hot material fed from the shaft furnace, to be reheated to the temperature necessary for hot preforming.

This solves the problem of taking care of waste material from the hot preforming machine in some other way, while at the same time considerably improving material utilization in the process.

We claim:

1. A method for making a preformed sponge iron product by direct reduction of ferric oxide-containing lump ore comprising (a) charging the ore into a shaft furnace for gravity flow there through, (b) passing a reducing gas through said ore to produce sponge iron having reducing gas in the pores thereof, (c) introducing non-combustible gas into the bottom of said furnace under pressure to heat the gas from the excess heat of the furnace, (d) discharging said iron and heated pressurized non-combustible gas from said furnace through a gas lock to a preforming machine to form said preformed sponge iron product, and (e) cooling said product, while blanketed in said non-combustible gas, to a temperature below the oxidation point of said reducing gas.

2. The method of claim 1 wherein said non-combustible gas is heated to a temperature sufficient to maintain said sponge iron at preforming temperature.

3. The method of claim 2 wherein a fresh portion of said heated non-combustible gas is added to the sponge iron, non-combustible gas mixture just before said preforming step.

4. The method of claim 2 in which the flow of sponge iron toward said preforming machine is controlled by said gas lock and includes the step of providing a collecting pocket between said furnace and said gas lock to compensate for variations in the rate at which said sponge iron flows.

5. The method of claim 2 in which said non-combustible gas is heated in step (c) to a temperature above 650° C. and is cooled in step (e) to a temperature below 200° C.

6. The method of claim 4 in which the quantity of sponge iron in said collecting pocket is used to control the feedout from said furnace.

7. The method of claim 4 in which said non-combustible gas is removed from the lower end of said pocket and which includes the steps of providing a restriction in the lower end of said pocket, causing the sponge iron to pass through said restriction, and maintaining a pressure drop across the restriction, thereby regulating the flow rate of non-combustible gas passing from said pocket to said gas lock to keep the sponge iron hot.

8. The method of claim 7 in which reducing gas is removed from said pocket along with said non-combustible gas.

* * * * *